US006506106B2

(12) United States Patent
Fletcher

(10) Patent No.: US 6,506,106 B2
(45) Date of Patent: Jan. 14, 2003

(54) AUTOMATED RAZOR SHARPENING DEVICE

(76) Inventor: Charles J. Fletcher, 15 Seminole Ct., Fredon Township, Newton, NJ (US) 07860

( * ) Notice: Subject to any disclaimer, the term of this patent is extended or adjusted under 35 U.S.C. 154(b) by 55 days.

(21) Appl. No.: 09/846,296

(22) Filed: May 2, 2001

(65) Prior Publication Data

US 2002/0164935 A1 Nov. 7, 2002

Related U.S. Application Data

(60) Provisional application No. 60/230,947, filed on Sep. 6, 2000.

(51) Int. Cl.[7] ..... B24B 7/00

(52) U.S. Cl. ..... 451/293; 451/45; 451/162; 451/163; 451/349; 451/356; 451/121; 451/150; 451/160; 451/191; 451/205

(58) Field of Search ..... 451/45, 162, 163, 451/349, 356, 365, 371, 556, 121, 124, 150, 160, 191, 192, 205, 206, 229, 321

(56) References Cited

U.S. PATENT DOCUMENTS 6,030,281 A * 2/2000 Cozzini et al. ..... 451/320

* cited by examiner

*Primary Examiner*—Joseph J. Hail, III
*Assistant Examiner*—Shantese McDonald
(74) *Attorney, Agent, or Firm*—Connolly Bove Lodge & Hutz LLP

(57) ABSTRACT

Apparatus for sharpening a razor blade with a motor actuated sharpening member mounted in a housing with a slot for receiving the razor head and a cradle assembly for engaging the distal end of the razor handle to hold the razor head in the slot. A carriage assembly holds the sharpening member opposite to the slot with its sharpening surface engaging the cutting edge of a razor blade secured in the razor head. A drive assembly driven by a motor operated by a timing circuit causes repetitive movement of the sharpening surface for a predetermined period of time.

8 Claims, 4 Drawing Sheets

AUTOMATED RAZOR SHARPENING DEVICE

CROSS REFERENCE TO RELATED APPLICATION

The present application claims priority under 35 U.S.C.§119(e) from U.S. provisional application Ser. No. 60/230,947, filed Sept. 6, 2000.

FIELD OF THE INVENTION

The present invention relates in general to apparatuses for sharpening razor blades, and relates more particularly to a motor operated apparatus for sharpening razor blades used for shaving hair from the human body.

BACKGROUND OF THE INVENTION

Hand-held safety razors, typically used for shaving the face, legs, and other hairy regions of the human body, generally consists of a metal and/or plastic handle attached to a razor head for holding one to three razor blades, with multiple blades being arranged in parallel. Generally, the razor blades are capable of a maximum number of close shaves between four and 15, depending on the coarseness of the hair being shaved. Thereafter, the cutting edge portion of the blade become so dull that the user must either change blades or, in the case of disposable razors, must discard the dull razor for a new one.

The inventor of the present device was previously granted U.S. Pat. No. 5,036,731 on a hand operated device for sharpening the blades of such hand-held razors. Although this hand operated device also greatly extended the useful life of such razors, the hand operation thereof was somewhat slow and required precise hand positioning of the razor handle for each sharpening stroke in order to achieve maximum effectiveness. There is therefore a need for a quick, precise and automated means for re-sharpening the blades of hand-held razors in order to extend their useful life.

SUMMARY OF THE INVENTION

It is accordingly one object of the present invention to provide a motorized apparatus for sharpening the cutting edge of one or more razor blades in the head of a hand-held razor. Other objects of this invention are to provide an apparatus which can rapidly and automatically sharpen one or more blades while precisely positioning the head in which the blades are mounted. It is also desirable to provide such an apparatus in a compact and durable form.

In accordance with the present invention, there is provided an improved electrically operated razor blade sharpening apparatus (sharpener) for sharpening the cutting edge of one or more razor blades that are mounted within a razor head having a plastic or metal handle attached thereto. The sharpener may have a plastic or metal housing which may contain all of the moving components. An electric drive system of the sharpener comprises a small electric motor and a reduction gear assembly which drives a cam assembly arranged to slidingly oscillate back and forth a carriage on which is mounted a rectangular strip or slide of mildly abrasive material, which may be a hard vitreous material such as, for example, glass, porcelain, or a ceramic.

The abrasive slide is just wide enough to fit between the outer lips of a typical razor blade head so that the head lips will engage opposite edges of the slide to provide a track for the blade(s) to follow during the oscillatory motion of the slide carriage. The electric motor is operated by an electrical system, which includes a switch that is mounted on the outside of the housing and is manually operated to actuate the electric motor. The electric system also includes a timing circuit that allows the sharpener to stroke the cutting edges of the razor blades for a predetermined period of time, such as 20 to 60 seconds, preferably about 35 seconds, before automatically shutting off the motor.

The electrical and mechanical components of the carriage and its drive system, including all moving parts, are housed preferably within a thin plastic shell. None of the moving parts are visible to the eye, except for a partly visible portion of the abrasive slide, which may be seen through a blade-mounting slot located in a front wall of the housing when the razor head is absent from the slot. When the razor is mounted for sharpening, the rearward most portion (distal end) of the razor handle rests within a slidable cradle, which is spring biased so as to push the razor blade head into the blade-mounting slot so that each razor blade firmly rests against the abrasive slide which is located within the housing adjacent and opposite to the inner side of the blade-mounting slot. The tension of a spring mounted between a stud on the cradle and a stud on the housing causes the razor to remain firmly in the required position for sharpening the blade(s) during the sharpening cycle of the apparatus.

While the present device has a similar sharpening ability as the hand operated device previously mentioned, the present device achieves an improved degree of sharpness by means of the electrically operated arrangement that accomplishes automatically what was previously accomplished by a hand stroking action. Although the sharpening performance of the present motorized device may be comparable to the sharpening performance of the hand stroked device, one advantage of the present device is that it provides a simple and precise way to mount the razor blade to achieve the sharpening process with little or no manual effort and in the shortest possible time.

In the present disclosure, the razor blade head and its handle are mounted in a simple and precise way to allow the planar slide of the abrasive substance to move back and forth over the cutting edge of the blade(s) through a stroking distance of about 1 to about 1.5 inches, more preferably about 1.0625 inches. This oscillatory motion is provided by the cam assembly driven by the small electric motor. The oscillatory motion is preferably programmed to run for a predetermined period of time, such as 35 seconds, by the timing circuit.

The abrasive slide, which hones the edge of each razor blade, is designed to fit between the outer lips of the head that supports the razor blade(s). This provides the track effect that guides the blade(s) relative to the abrasive slide during the oscillatory sharpening motion of the latter. Testing of the present motorized sharpening device indicates that the useful life of typical hand-held razors, such as a GILLETTE, SCHICK and BIC, may be extended from about 10 to about 150 shaves, or about 1500%. Such improved sharpening performance could result in a substantial economic improvement to the user, while continuing to provide smooth and close shaves with minimal cuts or nicks.

BRIEF DESCRIPTION OF THE DRAWINGS

The invention is further described in the Detailed Description below taken in conjunction with the accompanying drawings in which.

DETAILED DESCRIPTION OF THE INVENTION

Figure 1:
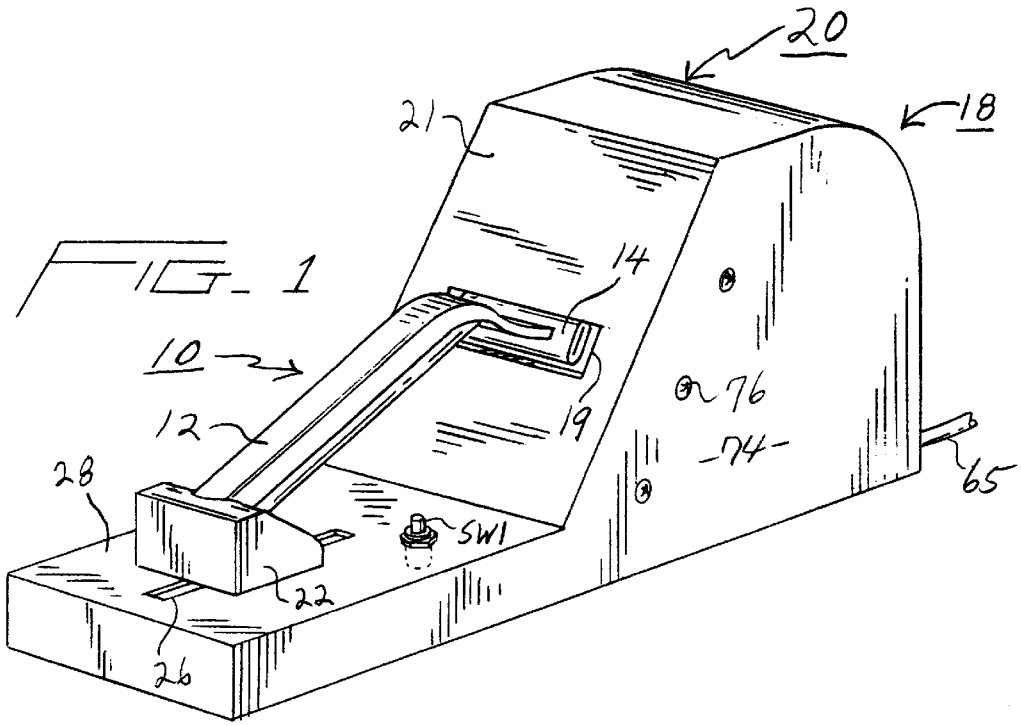
FIG. 1 is a front view in perspective of the razor sharpening apparatus of the present invention showing a safety razor in position for the sharpening process.

Referring now to FIGS. 1–5, a manual, hand-held shaving razor 10, having a handle 12 and a head 14 with dual razor blades 15 and 16, is held in a mounted position for sharpening by the razor sharpening apparatus of the invention, generally designated 18. The razor head 14 is held in a slot 19 in a front wall 21 of a housing 20, preferably made of a relatively thin plastic material. This holding action is provided by a cradle 22 having a shaped receptacle 24 for engaging and pushing against the distal end of the razor handle 12. The tapered contour of the receptacle 24 is such that, regardless of the size or shape of the rear portion (distal end) of the razor handle 12, this rear portion will always center itself in the receptacle so that the razor blade head 14 will be precisely positioned in the housing slot 19 with the cutting edge of each razor blade resting squarely against the flat surface of the abrasive slide 40. The receptacle 24 of cradle 22 preferably has a generally parabolic shape, such as that shown in FIG. 3, so as to fittingly receive and engage the distal end of handles of different sizes, as illustrated by the broken lines H1 and H2. Thus, the sharpening device of the present invention is usable with a wide variety of razors, each of which may have a handle of a unique size and shape.

The cradle 22 is guided in a slot 26 in an upper planar wall 28 of housing 20 by a depending ridge 30 that fits closely within the slot 26. The cradle 22 is held for reciprocal travel in the slot 26 by a cradle slide 32 secured to the cradle ridge 30 by a pair of screws 34, 34. Cradle 22 is biased toward the razor head slot 19 by a tension spring 36 that extends between a depending stud 38 on the underside of housing wall 28 and a depending stud 40 on the underside of the cradle slide 32, as may be seen best in FIG. 2.

Referring now to FIGS. 2, 4, 6, and 8, the biasing action of spring 36, acting through the cradle 22 and the razor handle 12, firmly holds the razor head 14 in the housing slot 19, and also presses the cutting edges of dual blades 15 and 16 against the abrasive slide 40 positioned opposite and adjacent to the slot 19. Slide 40 is arranged for oscillating movement in an interior chamber 42 of the housing 20 and for this purpose, is mounted by an adhesive or the like in a recess 44 formed by lips 45, 45 of a carriage 46. Carriage 46 is arranged for oscillatory sliding motion in a track formed by opposing grooves 48, 48 in the legs 50, 50 of a U-shaped support member 52, as may be seen best in FIG. 8. On the side of carriage 46 opposite to the slide recess 44 is a pair of cam rails 54, 54 that define therebetween a channel 56 for receiving a cam roller 58 rotatably mounted on an arm 60 by a screw 61. The arm 60 is driven in rotation by a drive shaft 62 connected to a motor 64 through a reduction gear box 66, the arm 60 being secured to the shaft 62 for rotation therewith by a pair of set screws 68, 68, one of which is positioned to engage a flat surface 69 on the shaft 62 to ensure that slippage does not occur between the arm 60 and the shaft 62. The gear ratios in gear box 66 are such that drive shaft 62 rotates at a speed less than the rotation speed of the output shaft 67 of motor 64.

Figure 7:
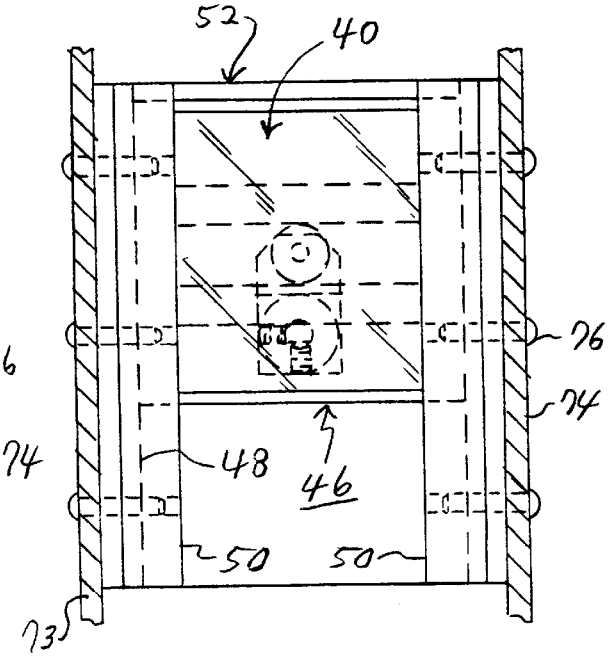
FIG. 7 is a fragmentary cross sectional view similar to FIG. 5, but taken along line 7—7 of FIG. 6.
Figure 6:
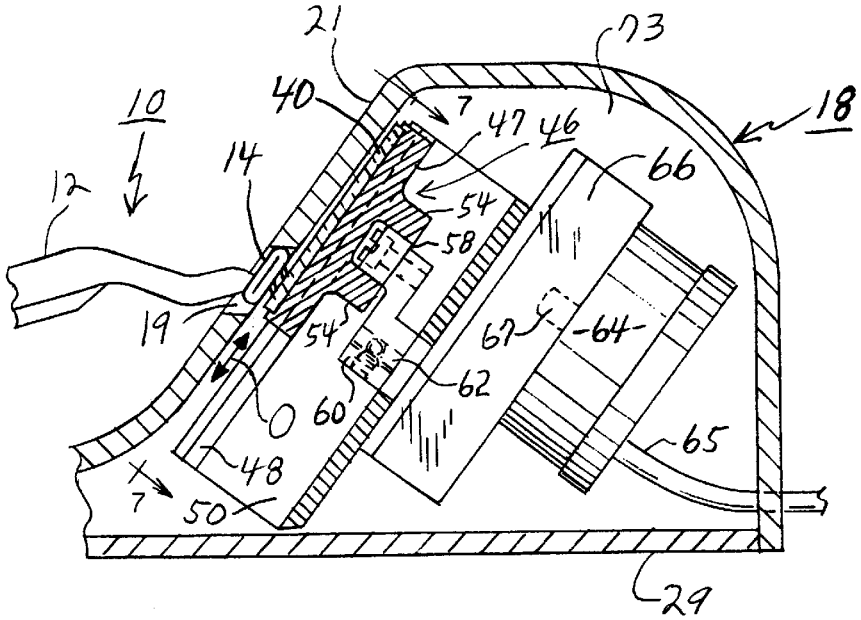
FIG. 6 is a side elevational view in partial cross section similar to FIG. 2, but fragmentary and showing the abrasive slide and its supporting carriage in a moved position.
Figure 8:
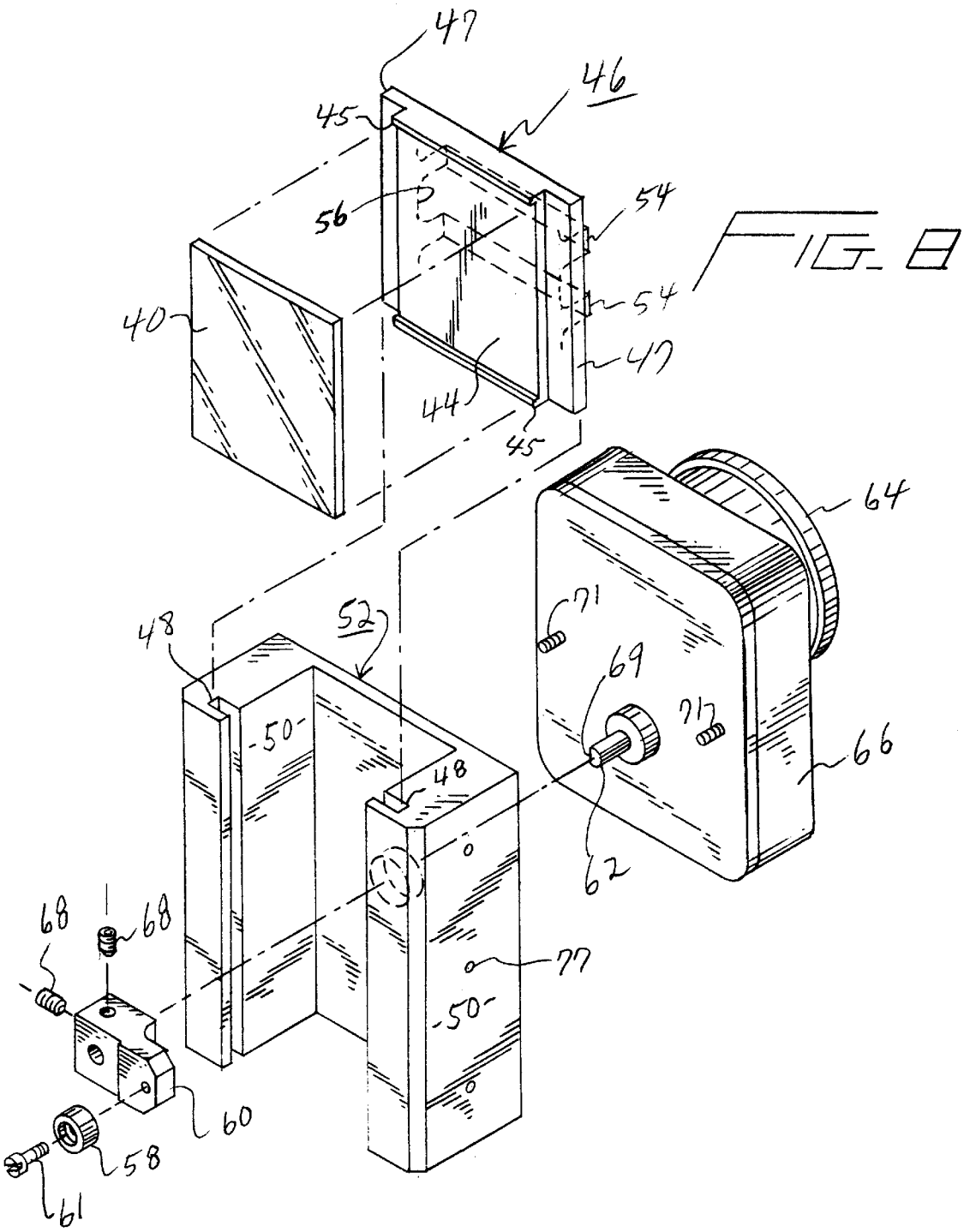
FIG. 8 is an exploded perspective view showing the drive mechanism and related components for providing oscillatory motion of the abrasive slide and its supporting carriage.

The motor 64 and the gear box 66 are secured to the base of the support member 52 by a pair of screws 71, 71, and in turn the support 52 is secured to opposing side walls 73 and 74 of the housing 20 by a plurality of screws 76 (FIG. 1), which engage a corresponding series of holes 77 in the legs 50 of the support member 52. When the driving arrangement for the carriage 46 is thus assembled, rotation of the arm 60 by the shaft 62 causes the cam roller 58 to move back and forth (oscillate) in the channel 56 (from side to side relative to support member 52), which in turn causes carriage 46 to move back and forth (oscillate) in the grooves 48, 48 (up and down relative to support member 52). In other words, the channel 56 formed by the cam rails 54, 54 receives and is driven by the cam roller 58 during its rotational motion, and the track formed by opposing slots 48, 48 receives and guides opposite edges 47, 47 of the carriage 46 during its resulting oscillatory motion, as represented by the double-ended arrow O in FIGS. 2 and 6. In this regard, the abrasive slide 40 and its carriage 46 are shown in an intermediate position in FIGS. 2 and 5 and in their uppermost position in FIGS. 6 and 7. It follows from this that slide 40 oscillates back and forth across the opening of slot 19 in the direction perpendicular to the longitudinal axis of this opening and to the longitudinal axis of the razor blade head.

Figure 9:
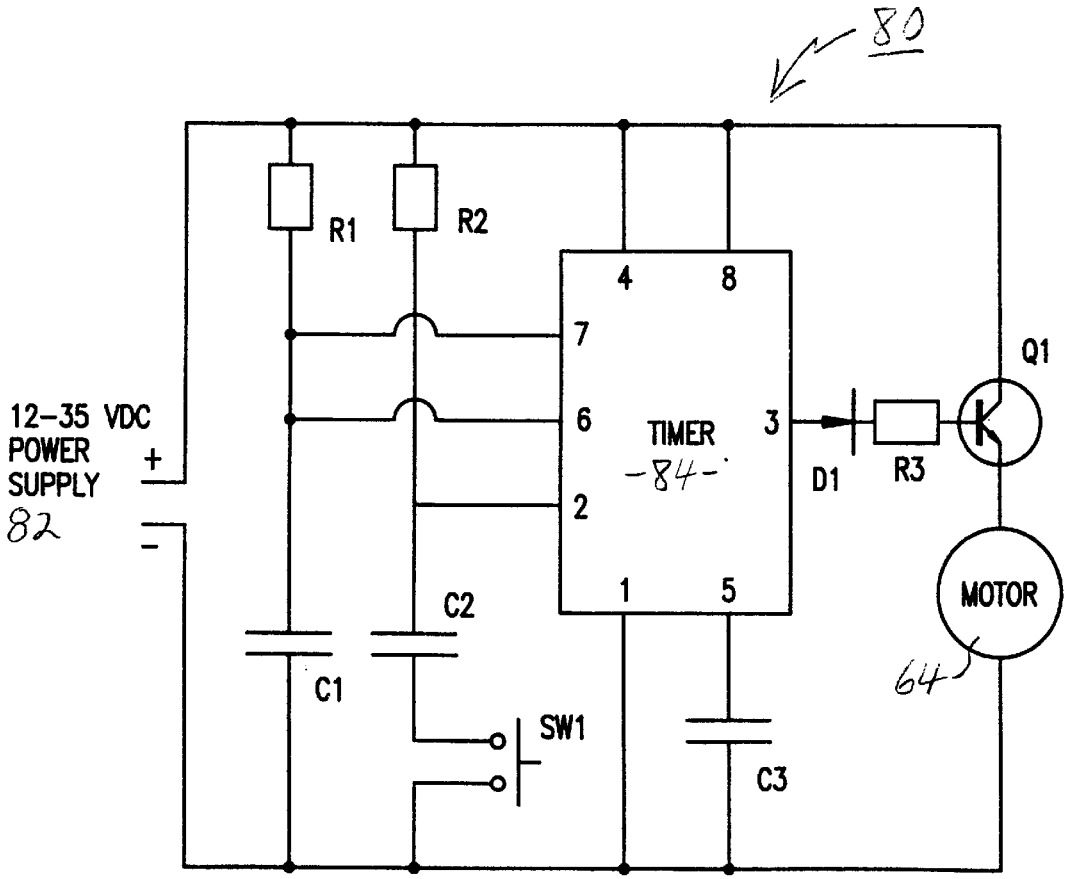
FIG. 9 is a diagram of the electrical circuit for providing a timed operation of the motor driving the oscillatory motion of the abrasive slide and its mounting carriage.
Figures 2, 3, 4:
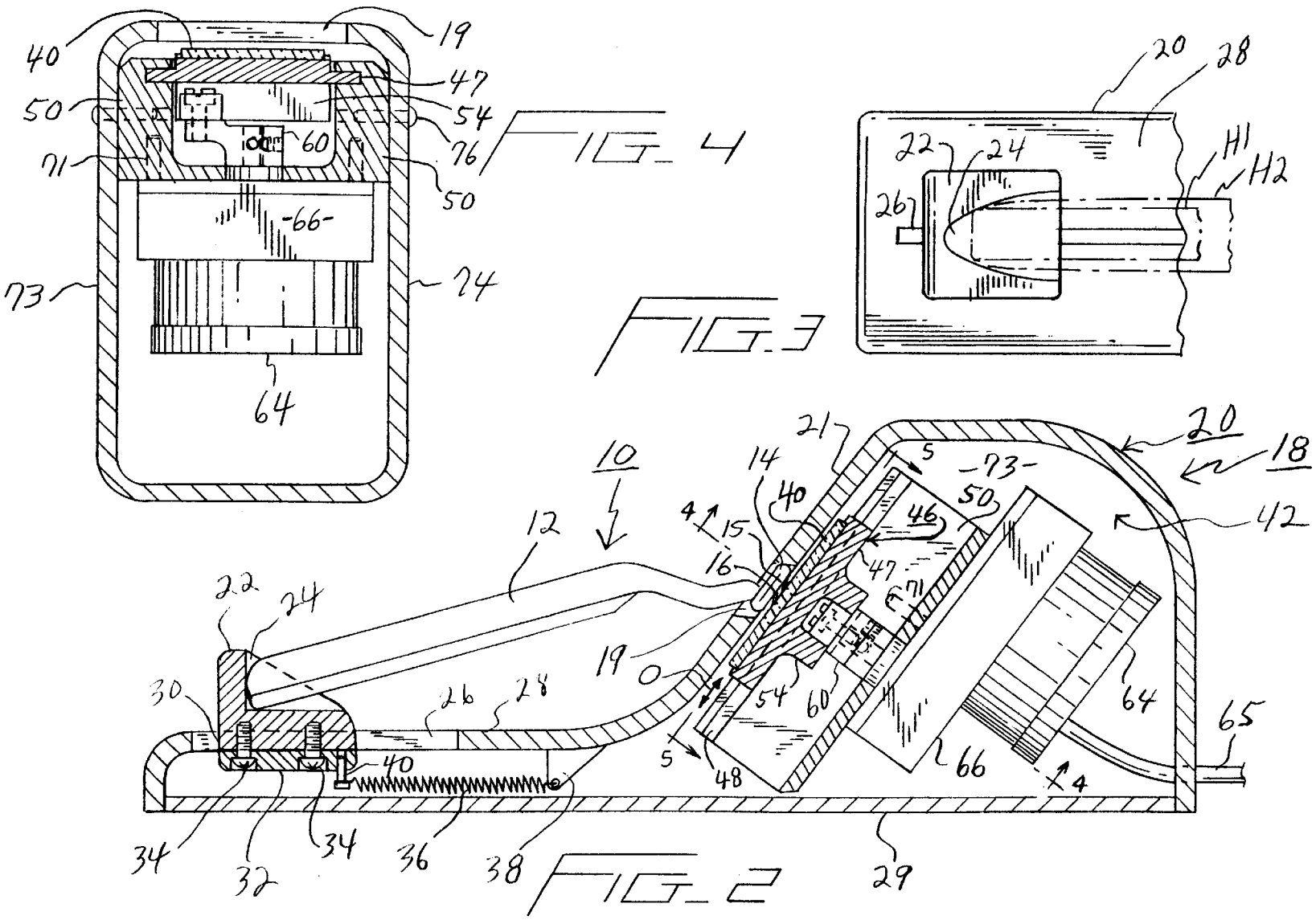
FIG. 2 is an elevational side view of the razor sharpening apparatus of FIG. 1 in partial cross section.
FIG. 3 is a fragmentary top view showing the cradle for supporting and biasing the razor handle.
FIG. 4 is a partial cross sectional view as taken along line 4—4 of FIG. 2.
Figure 5:
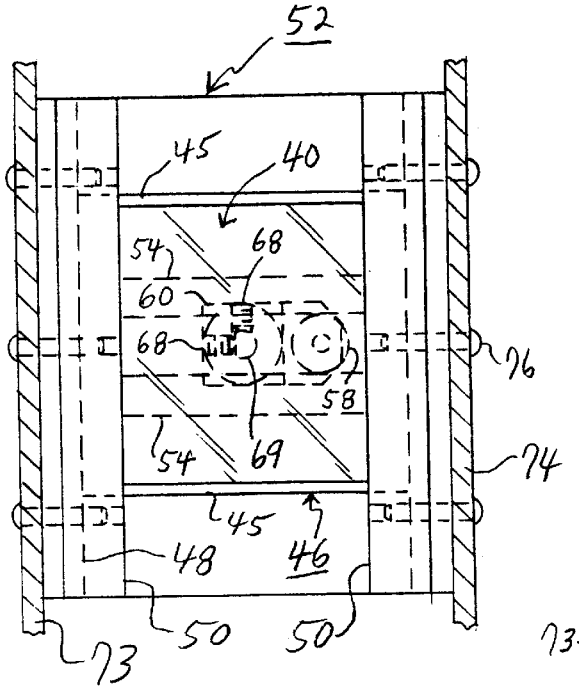
FIG. 5 is a fragmentary cross sectional view taken along line 5—5 of FIG. 2.

In FIG. 9, there is shown a preferred electrical system for operating the electric motor 64 and for automatically controlling the length of time that the motor is operated. Operation of the electric motor 64 starts upon actuation of a switch SW 1 mounted on the upper wall 28 of housing 20 as shown in FIG. 1. Referring now to FIG. 9, the electrical system, generally designated 80, is connected to a 12 to 35 volt direct current power supply 82 by an electrical cord 65 (FIGS. 1 and 2), the distal end of which may terminate in a conventional AC to DC transformer of the usual type that plugs into a standard home AC outlet.

The electrical system 80 includes a timing circuit that comprises three resistors R1, R2, and R3, three capacitors C1, C2, and C3, a timing circuit chip 84 having eight terminals 1–8, a diode D1, and a NPN bipolar transistor Q1. These electrical components are connected together by electrical lines or conductive tracks, as shown in FIG. 9. Actuation of biased open switch SW1 initiates operation of the motor 64 by connecting it to the power supply 82 through the timing circuit, and the motor 64 continues to run until its power supply is interrupted by the opening of transistor Q1, which acts as a switch that closes upon application of a voltage across chip 84, and that opens in response to bleeding off of this voltage to terminate the closure signal applied to the transistor Q1 via the diode D1 and the resistor R3. The values of D1, Q1, and R3 are selected based on the size of motor 64 and its load. The values of R2 and C2 are selected based on the desired run time, such as preferably about 35 seconds.

Resistor R1 may have a nominal value of 100 K ohms and capacitors C1 and C3 may have nominal values of 0.01 MF.

The chip 84 is preferably a generic 555 timer available from many sources, such as National Semiconductor, Fairchild, and Motorola. This timer chip comprises a latch that maintains terminal 3 in a high state in response to charging of the capacitor C2 upon a momentary closure of switch SW1, which is preferably a push button or toggle switch that is spring biased to its open position. When the capacitor C2 bleeds off to a predetermined voltage level, the terminal 3 of the timer chip goes to a low state, causing the transistor Q1 to open, thereby turning off motor 64.

While a specific razor sharpening apparatus has been described and illustrated in detail, it will be apparent to those skilled in the art that many modifications and variations are possible without deviating from the broad scope of the present invention. For example, a spring driven motor of the windup type or other motorized drive arrangements may be used to cause oscillation of the abrasive slide and its mounting carriage, and a variety of electrical circuits may be employed for continuous or timed operation of the drive motor 64. In addition, the drive assembly may be arranged to cause repetitive rotary movement of the sharpening member (slide) relative to the razor head 14 and slot 19, instead of the repetitive linear oscillatory movement described above. Thus, the specific embodiment described herein is for the purpose of illustrating the present invention, and workers skilled in the art will recognize variations thereof that fall within the scope of this invention, which: is limited only by the claims appended hereto, and equivalents of the features described therein.

What is claimed is:

1. An apparatus for sharpening the cutting edge of at least one razor blade secured within a holder, said holder having a razor head for retaining said blade in a cutting position and a handle connected to said head for manipulating said blade, said apparatus comprising:

a housing having an upstanding wall with a slot for receiving said razor head;

a cradle assembly for engaging a distal end of said razor handle to hold said head in a sharpening position within said slot;

a sharpening assembly mounted in said housing and comprising a sharpening member having a sharpening surface made of a material for sharpening said razor blade;

a carriage assembly comprising a carriage for holding said sharpening member opposite to said head slot with said sharpening surface in an engagement position for engaging a cutting edge of said razor blade; and, a drive assembly driven by a motor and arranged to cause repetitive movement of said carriage and said sharpening member while said sharpening surface engages the cutting edge of said razor blade to sharpen the same.

2. A sharpening apparatus according to claim 1, wherein said cradle assembly comprises a cradle having a foot portion arranged in a guide slot in a supporting wall of said housing to guide said cradle toward and away from said head slot, and a spring member connected between said cradle and said housing for biasing-said cradle toward said head slot, such that said spring bias causes the cutting edge of said razor blade to be pressed against the sharpening surface of said sharpening member.

3. A sharpening apparatus according to claim 2, wherein said cradle has a receptacle for receiving the distal end of said razor handle, said receptacle having a tapered wall facing said upstanding housing wall and being tapered from an open mouth to a bottom to center and align said razor handle relative to said head slot, and the mouth of said receptacle being of sufficient size to receive distal handle ends of different sizes.

4. A sharpening apparatus according to claim 1, wherein said drive assembly is arranged to cause linear oscillating movement of said sharpening member while said sharpening surface is engaged by said razor blade.

5. A sharpening apparatus according to claim 4, wherein said linear oscillating movement is in a direction substantially perpendicular to a linear direction of the cutting edge of said blade.

6. A sharpening apparatus according to claim 1, wherein said carriage is mounted for linear oscillating movement along a linear track formed by a support member mounted in said housing;

wherein said carriage comprises a pair of rails on a side of said carriage opposite to said sharpening member, said rails defining an elongated channel for receiving a cam member of said drive assembly; and wherein said drive assembly further comprises an arm secured to a drive shaft for rotation therewith around a rotational axis, said cam member being mounted on said arm at a position transversely offset from said rotational axis such that said cam member engages said channel rails to cause said linear oscillating movement when said arm is rotated by said drive shaft.

7. An apparatus according to claim 6, wherein said drive assembly further comprises a reduction gear assembly for rotating said drive shaft in response to rotation of an output shaft of said motor, said reduction gear causing said drive shaft to rotate at a speed less than a rotation speed of said motor output shaft.

8. A sharpening apparatus according to claim 1, wherein said motor is electrically operated, and wherein said apparatus further comprises an electrical circuit for providing electrical power to said motor for a predetermined period of time, said electrical circuit comprising a switch for initiating said motor operation and a timing circuit for shutting off electrical power to said motor at the end of said predetermined period of time.

* * * * *